US009595757B2

(12) United States Patent
Saint Clair et al.

(10) Patent No.: US 9,595,757 B2
(45) Date of Patent: Mar. 14, 2017

(54) INTEGRAL RF-OPTICAL PHASED ARRAY MODULE

(71) Applicant: The Boeing Company, Chicago, IL (US)

(72) Inventors: Jonathan Martin Saint Clair, Seattle, WA (US); Julio A. Navarro, Kent, WA (US)

(73) Assignee: The Boeing Company, Chicago, IL (US)

( * ) Notice: Subject to any disclaimer, the term of this patent is extended or adjusted under 35 U.S.C. 154(b) by 385 days.

(21) Appl. No.: 14/183,054

(22) Filed: Feb. 18, 2014

(65) Prior Publication Data

US 2015/0180122 A1 Jun. 25, 2015

Related U.S. Application Data

(60) Provisional application No. 61/920,599, filed on Dec. 24, 2013.

(51) Int. Cl.

| | |
|---|---|
| ***H01Q 5/22*** | (2015.01) |
| ***H01Q 3/26*** | (2006.01) |
| ***H01Q 23/00*** | (2006.01) |
| *H01Q 3/00* | (2006.01) |
| *H01Q 5/00* | (2015.01) |

(52) U.S. Cl.

CPC ..... *H01Q 5/22* (2015.01); *H01Q 3/26* (2013.01); *H01Q 3/2676* (2013.01); *H01Q 23/00* (2013.01); *Y10T 29/49016* (2015.01)

(58) Field of Classification Search

CPC ..... Y10T 29/49; Y10T 29/49002; Y10T 29/49016; H01Q 23/00; H01Q 3/26; H01Q 3/2676; H01Q 5/20; H01Q 5/22

See application file for complete search history.

(56) References Cited

U.S. PATENT DOCUMENTS 3,878,520 A * 4/1975 Wright ..... H01Q 3/2676 342/368
4,028,702 A * 6/1977 Levine ..... H01Q 3/2676 342/374

(Continued)

FOREIGN PATENT DOCUMENTS

EP 0519772 A1 * 12/1992 ..... H01Q 3/26
WO WO93/11579 A1 * 6/1993 ..... H01Q 3/26

OTHER PUBLICATIONS

Polishuk et al., "Communication performance analysis of microsatellites using an optical phased array antenna," Opt. Eng. 42(7), Jul. 1, 2003, pp. 2015-2024.

*Primary Examiner* — Bernarr Gregory
(74) *Attorney, Agent, or Firm* — Charles L. Moore; Moore & Van Allen PLLC

(57) ABSTRACT

An integral phased array module may include a substrate and a radio frequency (RF) element provided in relation to the substrate. The RF element being configured to at least one of transmit and receive RF signals. The RF element includes a footprint of a particular size and shape with respect to the substrate and the substrate is sized to accommodate the footprint of the RF element. The integral phased array module may also include an optical function element configured to perform an optical function. The optical function element is located relative to the RF element on the substrate for integrating multi-band functionality into a single aperture.

20 Claims, 6 Drawing Sheets

(56) References Cited

U.S. PATENT DOCUMENTS

| | | | | | |
|---|---|---|---|---|---|
| 4,258,363 | A * | 3/1981 | Bodmer | H01Q 3/2676 | 342/157 |
| 4,725,844 | A * | 2/1988 | Goodwin | H01Q 3/2676 | 342/374 |
| 4,751,513 | A * | 6/1988 | Daryoush | H01Q 3/2676 | 343/700 MS |
| 4,885,589 | A * | 12/1989 | Edward | H01Q 3/2676 | 342/175 |
| 5,029,306 | A * | 7/1991 | Bull | H01Q 3/2676 | 342/368 |
| 5,222,162 | A * | 6/1993 | Yap | H01Q 3/2676 | 385/14 |
| 5,543,805 | A * | 8/1996 | Thaniyavarn | H01Q 3/2676 | 342/368 |
| 5,694,498 | A * | 12/1997 | Manasson | H01Q 3/2676 | 342/200 |
| 5,926,592 | A | 7/1999 | Harris | | |
| 6,320,539 | B1 * | 11/2001 | Matthews | H01Q 3/2676 | 342/375 |
| 6,967,772 | B2 | 11/2005 | Harris | | |
| 7,082,230 | B2 * | 7/2006 | Huang | H01Q 3/2676 | 324/96 |
| 7,084,811 | B1 * | 8/2006 | Yap | H01Q 3/2676 | 342/373 |
| 7,123,790 | B2 | 10/2006 | Rosman | | |
| 7,248,390 | B2 | 7/2007 | Harris | | |
| 7,330,305 | B2 | 2/2008 | Harris | | |
| 7,338,439 | B2 | 3/2008 | Kanai | | |

* cited by examiner

INTEGRAL RF-OPTICAL PHASED ARRAY MODULE

CROSS-REFERENCE TO RELATED APPLICATIONS

This application claims the benefit of U.S. Provisional Application No. 61/920,599, filed Dec. 24, 2013.

FIELD

The present disclosure relates to antennas and radar systems, radio frequency (RF) sensing and communications functions, and optical sensing and communications functions, and the like, and more particularly to an integral RF-optical phased array module.

BACKGROUND

In general, sensors have single band operability. For instance, typical radar systems emit radio frequency (RF) waves through the atmosphere, reflect off a target and returned to the radar system to be processed. Other sensors may emit energy that is not in the RF band. For instances, laser detection and ranging, or LADAR uses optical beams instead of RF waves to scan a field of view to determine distance and other information. Similarly, communications systems tend to have single band operability. Optical or RF communications and optical or RF sensing may be described as optical functions or RF functions. An optical system is desirable but can be ineffective under certain environmental conditions such as dust storms which make it difficult for the optical beam to travel as desired. Additionally, RF systems on mobile platforms can be compromised by jamming, blocking sensing, and effective communications between RF communications units. Thus, it is desirable to have a sensing and/or communications system that is capable of operating at either the optical band or the RF band in the event that the one band becomes ineffective due to operational environmental conditions.

Prior solutions to enabling multiple optical/RF operating bands included having both an optical function and a separate RF function. Such solutions added weight and required larger surface areas. In some applications, this was acceptable. However, when the dual band functionality was desired on platforms that have smaller surface areas and weight restrictions, such as unmanned aerial vehicles (UAVs) having multiple separate functions and systems was not practical.

SUMMARY

In accordance with an embodiment, an integral phased array module may include a substrate and a radio frequency (RF) element provided in relation to the substrate. The RF element being configured to at least one of transmit and receive RF signals. The RF element includes a footprint of a particular size and shape with respect to the substrate and the substrate is sized to accommodate the footprint of the RF element. The integral phased array module may also include an optical function element configured to perform an optical function. The optical function element is located relative to the RF element on the substrate for integrating multi-band functionality into a single aperture. In accordance with an embodiment, multiple optical elements or multi-spectral optical elements may be located relative to the RF element.

Multi-spectral optical elements may operate in different frequency ranges or bandwidths.

In accordance with another embodiment, a vehicle may include a vehicle body and an array of integral phased array modules mounted to the vehicle body. Each one of the integral phased array modules may include a substrate and a radio frequency (RF) element provided on the substrate. The RF element may be configured to at least one of transmit and receive RF signals. The RF element includes a footprint of a particular size and shape on the substrate and the substrate is sized to accommodate the footprint of the RF element. Each integral phased array module may also include an optical function element configured to perform an optical function. The optical function element is provided on the substrate with the RF element. The optical function element is located relative to the RF element on the substrate for integrating multi-band functionality into a single aperture.

In accordance with a further embodiment, a method for integrating multi-band functionality may include providing a substrate and providing an RF element on the substrate. The RF element may be configured to at least one of transmit and receive RF signals. The RF element includes a footprint of a particular size and shape on the substrate and the substrate is sized to accommodate the footprint of the RF element. The method may also include providing an optical function element configured to perform an optical function. The optical function element is provided on the substrate with the RF element. The method may further include integrating multi-band functionality into a single aperture by locating the optical function element relative to the RF element on the substrate.

BRIEF DESCRIPTION OF THE SEVERAL VIEWS OF DRAWINGS

The following detailed description of embodiments refers to the accompanying drawings, which illustrate specific embodiments of the disclosure. Other embodiments having different structures and operations do not depart from the scope of the present disclosure.

DETAILED DESCRIPTION

Figure 1:
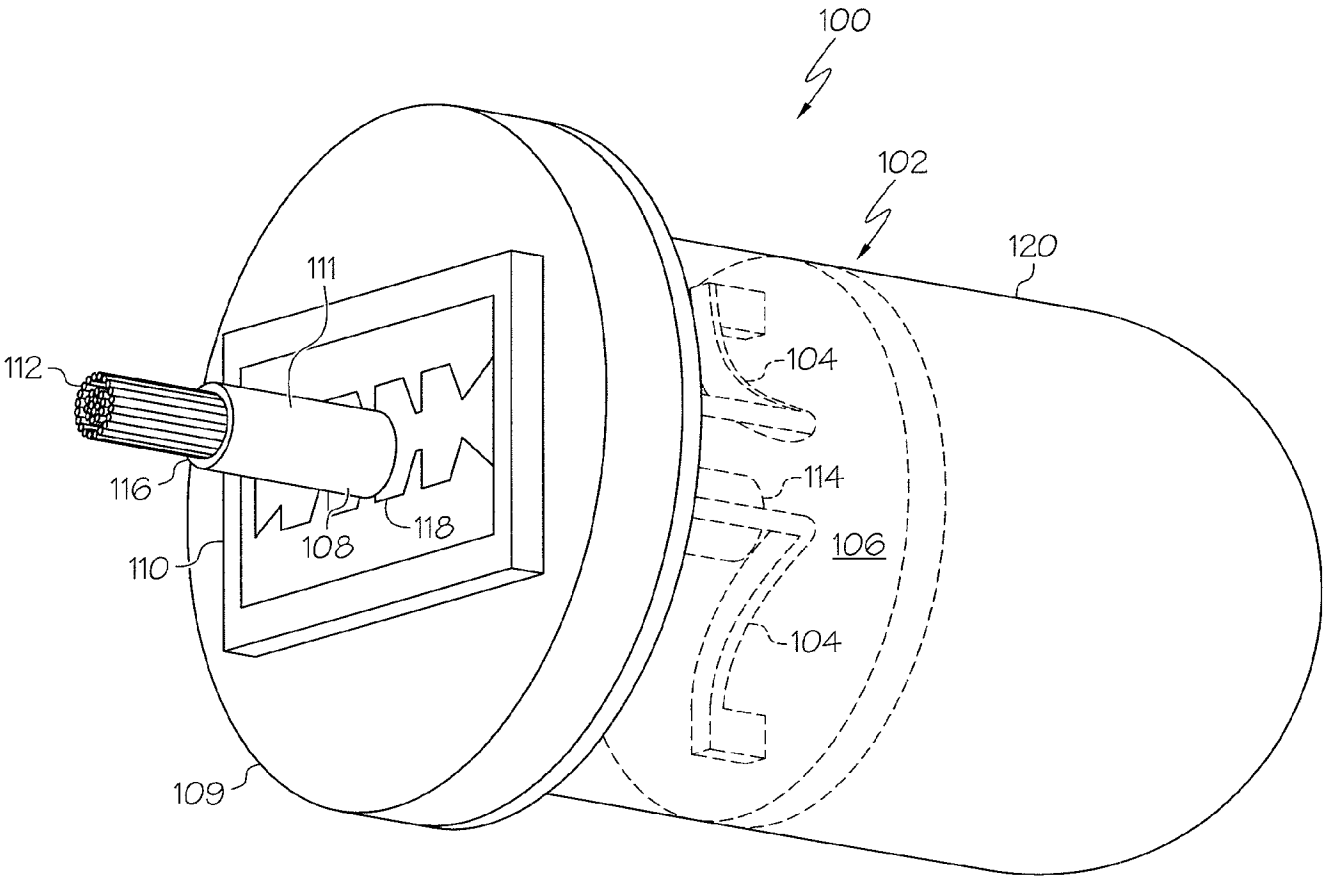
FIG. 1 is a perspective view of an example of an integral phased array module in accordance with an embodiment of the present disclosure.

The following detailed description of embodiments refers to the accompanying drawings, which illustrate specific embodiments of the disclosure. Other embodiments having different structures and operations do not depart from the scope of the present disclosure. Like reference numerals may refer to the same element or component in the different drawings.

As used herein, optical may refer to but is not necessarily limited to electromagnetic frequencies smaller than X-rays and larger than Microwave frequencies. Function may include but is not necessarily limited to sensing type functions, communications type functions and similar or related functions or operations. An optical function element or device may perform functions that may include optical beam forming, detection of optical energy, transmission of optical energy, refraction of optical energy, reflection of optical energy (optics) to concentrate or distribute optical energy and any other functions or operations related to optical energy. These functions may enable both active and passive sensing and communications.

FIG. 1 is a perspective view of an example of an integral phased array module 100 in accordance with an embodiment of the present disclosure. The integral phased array module 100 may include a support structure 102 and a radio frequency (RF) element 104 or a plurality of RF elements 104 provided in relation to the support structure 102. For example, the RF element 104 or elements may be supported by the ι or provided on the substrate 109 similar to that described herein. The substrate 109 may define an electromagnetic ground plane. The exemplary phased array module in FIG. 1 includes a plurality of RF elements 104. The RF elements 104 may include an array of antennas. The RF elements 104 may be configured to at least one of transmit and receive RF signals. The RF elements 104 may include a footprint 106 of a particular size and shape on the substrate 109 or relative to the substrate 109 and the substrate 109 may be sized to accommodate the footprint of the RF elements 104. In accordance with an embodiment, the footprint 106 of the RF elements 104 may be required to be no more than a certain size and shape, and the substrate 109 may be sized to accommodate only the footprint of the RF elements 104. For example, certain platforms, such as unmanned aerial vehicles (UAVs) or other vehicles, may have limited space and weight constraints to accommodate the RF elements 104 without any consideration to any modification or integration of any additional functional element or elements, such as an optical function element, as described herein, to provide multi-band function with a single aperture configured to fit within the footprint of the RF element 104 without substantially increasing the size of the substrate 109 and/or substantially altering the footprint 106 of the RF elements 104. By not substantially increasing the size of the substrate 109 and/or substantially altering the footprint 106 of the RF elements 104, the substrate 109 and/or footprint 106 may not be increased beyond the limits required to implement the RF elements 104 or modules in an array of integral phased array RF elements or modules with spacing between the centers of the elements or modules constrained by the RF frequency. In essence, the impact of any additional functional element or optical element may not cause an increase in the designed center-to-center spacing of the RF elements 106 in an array of RF elements based on the operating frequency or frequency range.

The integral phased array module 100 may include a function element 108. The function element 108 may include at least one of an optical function element as described in more detail herein. The function element 108 extends through the substrate 109 with the RF element 104. The function element 108 may also extend through a support structure 102 or base and may be supported by the support structure 102. Electronic circuitry 110 or a printed wiring board may also be mounted on the substrate 109 and the function element 108 may extend through an opening in the electronic circuitry 110. The electronic circuitry 110 may control operation of the integral phased array module 100 and may include components for receiving and processing radio frequency signals, optical signals or other types of signals. The function element 108 is located relative to the RF element 104 on the substrate 109 for integrating multi-band functionality into a single aperture without substantially increasing the size of the substrate 109 or the size of the footprint 106 of the RF element 104. The RF elements 104 may be part of a plurality of RF elements that define an antenna array. The function element 108 may be centrally located proximate a center of the substrate 109 with the RF elements 104 or antenna array outside of or surrounding the function element 108 on the substrate 109 as illustrated in FIG. 1. In other embodiments, the function element 108 may include a plurality of function elements. The function element 108 or elements may be located at other locations on the substrate 109 relative to the RF elements 104 or single RF element in some embodiments. For example, but not limited thereto, the function element 108 or elements may be located proximate an edge of the substrate 109. The function element 108 or elements may also be located relative to the RF elements 104 so as to not interfere with operation of the RF element 104 or the plurality of RF elements defining an antenna array, such as for example, distorting a radiation pattern of the RF element 104 or elements. The function element 108 may also be located relative to the RF elements 104 so that operation of the function element 108 is not adversely effected. For example, optical signals may be blocked or partial blocked by the function element 108 or optical function element.

The function element 108 or optical function element may include a tube 111 or pin. A single functional component or a plurality of functional components 112, as illustrated in the exemplary embodiment of FIG. 1, may be disposed or extend within the tube 111. The tube 111 includes a first end 114 disposed or mounted on the substrate 109 and a second end 116 opposite the first end 114. The tube 111 may extend substantially perpendicular from the substrate 109. In another embodiment, depending upon the application, the tube 111 may extend at a chosen angle relative to a plane of the substrate 109. As described in more detail with reference to FIG. 2, a beam manipulating mechanism for manipulating optical beams may be positioned in the tube 111 proximate to the second end 116 of the tube 111.

The tube 111 may be a substantially cylindrically-shaped tube or may be some other geometric shape depending upon the configuration of the RF element 104 or elements and footprint 106 of the RF element 104 or elements on the substrate 109. The tube 111 may be made from an electrically conductive material and may be at a ground electrical potential or grounded to a conductive element 118 or electrically conductive trace on the electronic circuitry 110 or printed wiring board which may be at ground electrical potential.

The integral phased array module 100 may also include an optical lens 120 that covers the RF element 104 or elements and function element 108. The lens 120 may be supported by the support structure 102.

Figure 2:
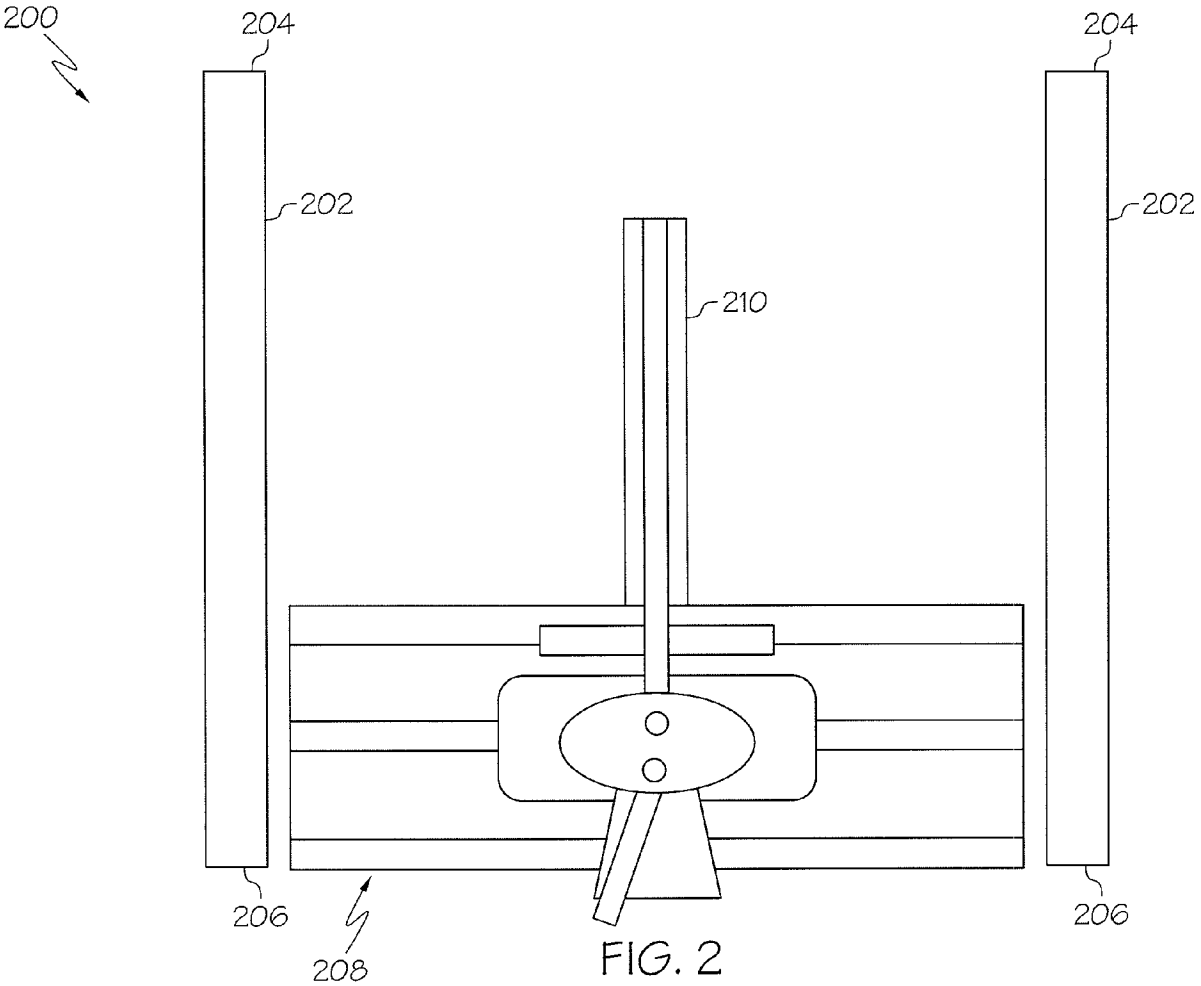
FIG. 2 is a side elevation view of an example of an optical function element for use in an integral phased array module in accordance with an embodiment of the present disclosure.

Referring also to FIG. 2, FIG. 2 is a side elevation view of an example of an optical function assembly 200 for use in an integral phased array module in accordance with an embodiment of the present disclosure. The optical function assembly 200 may be used for the function element 108 in FIG. 1. The optical function assembly 200 may include a tube 202. The tube 202 may be similar to tube 111 in FIG. 1. The tube 202 may include a first end 204 and a second end 206. The first end 204 may be attached to a substrate of an integral phased array module similar to that described with reference to FIG. 1. A beam manipulating mechanism 208 or mechanism for manipulating optical beams may be positioned in the tube 202 proximate to the second end 206 of the tube 202 opposite the first end 204 of the tube 202. The beam manipulating mechanism 208 may include a micro-optical-electro-mechanical system (MOEMS) or similar mechanism. An optical fiber 210 or a bundle of optical fibers may optically couple the beam manipulating mechanism 208 to an optical function device. The optical function device may be an optical signal transceiver or other device for processing optical signals.

Figure 3A:
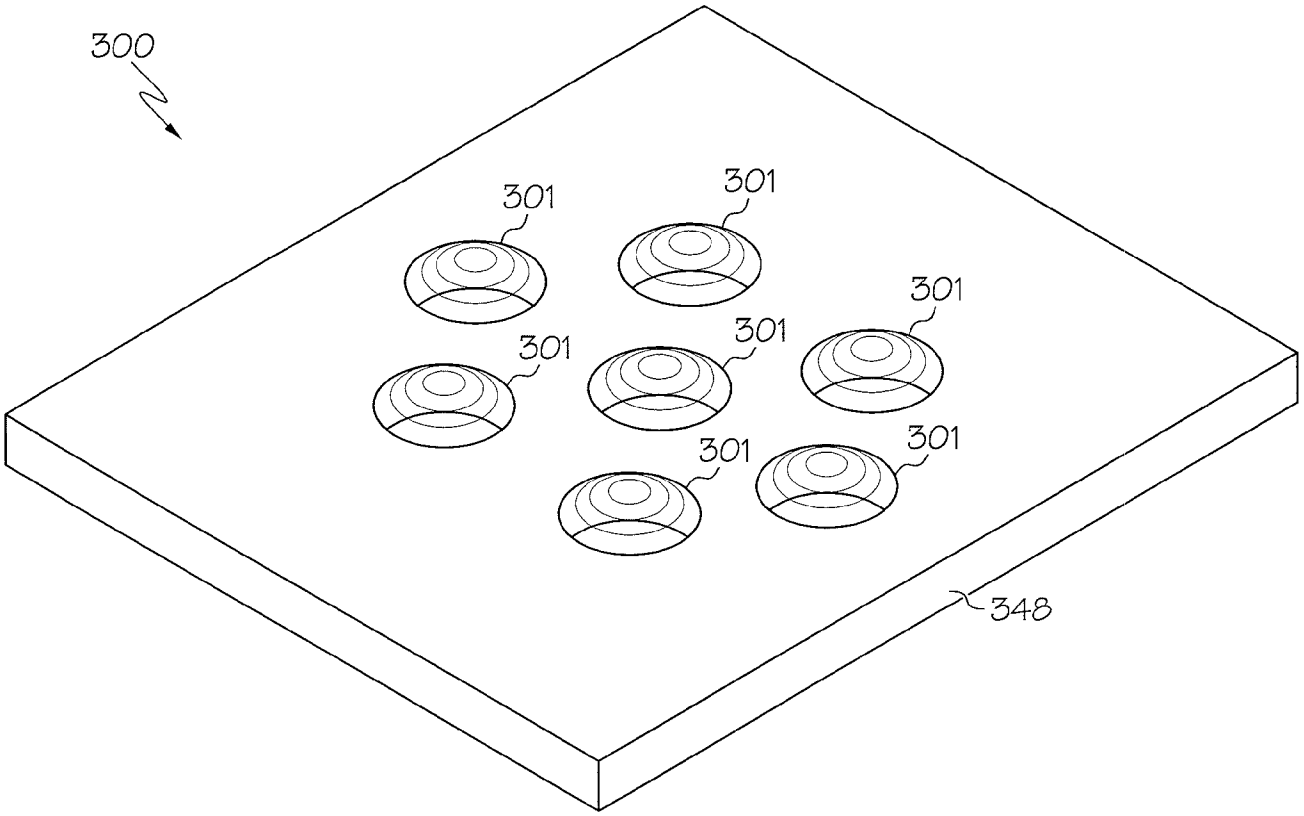
FIG. 3A is a perspective view of an example of an array of integral phased array modules in accordance with an embodiment of the present disclosure.
Figure 3B:
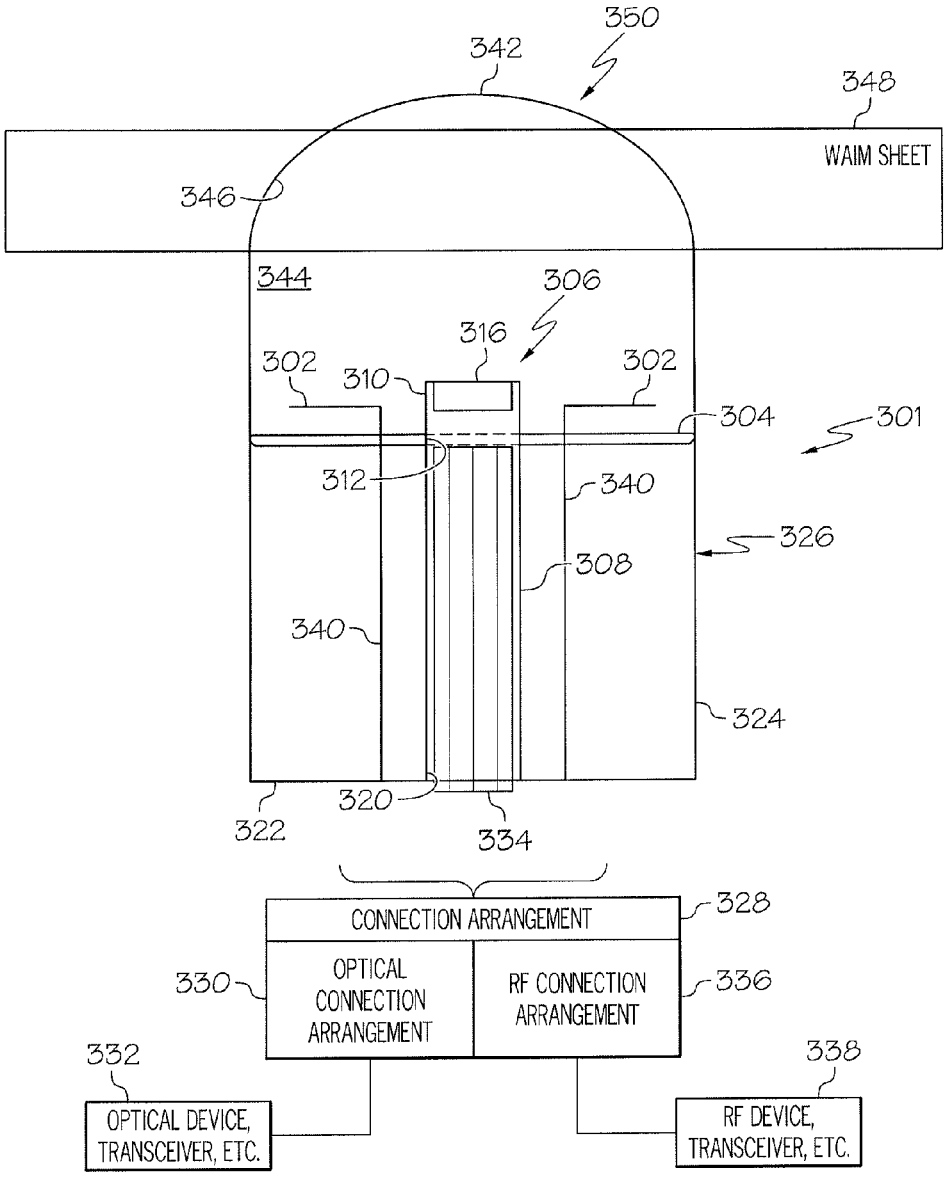
FIG. 3B is a cross-sectional view of one of the integral phased array modules of FIG. 3A.

Referring to FIGS. 3A and 3B, FIG. 3A is a perspective view of an example of an array 300 of integral phased array modules 301 in accordance with an embodiment of the present disclosure. FIG. 3B is a cross-sectional view of one of the integral phased array modules 301 of FIG. 3A. The integral phased array module 301 may include one or more RF elements 302 provided relative to a substrate 304. The substrate 304 may define a ground plane. The RF elements 302 may extend from the substrate 304 and may be supported by the substrate 304. The RF elements 302, as shown in the exemplary embodiment of FIG. 3B, may include an array of antennas for at least one of transmitting and receiving RF signals, such as radar signals or other electromagnetic signals.

The integral phased array module 301 may also include an optical function element 306. The optical function element 306 may also be a plurality of optical function elements or an array of optical function elements. The optical function element 306 may be similar to the optical function assembly 200 described with reference to FIG. 2. The optical function element 306 may include a tube 308 including a first end 310 that may extend through an opening 312 in the substrate 304. The first end 310 of the tube 308 may extend a predetermined distance from the substrate 304. The predetermined distance may be determined to avoid any interference between the optical function element 306 and the RF elements 302, i.e., prevent any blockage or partial blockage of optical beams from the optical function element 306. In another embodiment, the tube 308 may not extend above a surface of the substrate 304. The optical function element 306 may also be located relative to the RF elements 302 so as to not interfere with operation of the RF elements 302.

A beam manipulating mechanism 316 may be positioned in the tube 308 proximate the first end 310 of the tube 308. The beam manipulating mechanism 316 may be configured for manipulating optical beams being transmitted or received by the optical function element 306. The beam manipulating mechanism 316 may be an MOEMS or similar system capable of manipulating or steering optical beams. A second end 318 of the tube 308 may extend through or mate with an opening 320 in a base 322 of a housing 324 of the integral phased array module 301. The tube 308 may be made from an electrically conductive material and may be at ground electrical potential. For example, the tube 308 may be electrically grounded to the substrate 304 which may be at ground electrical potential. The tube 308 may be a cylindrically shaped tube or may be some other shape configured for integrating the optical function element 306 with the RF elements 302 into a single aperture without substantially increasing the size of the substrate 304 and substantially altering the footprint or layout of the RF elements 302 and without any significant degradation of performance of the optical function element 306 or RF elements 302 if the elements where separate units.

A portion of the integral phased array module 301 between the base 322 and the substrate 304 may be referred to as a back-short 326. A connection arrangement 328 coupled to the back-short 326 may include an optical connection arrangement 330 configured to couple the optical function element 306 to an optical device 332. The optical device 332 may be an optical transceiver or other device for performing predetermined functions based on the signals received by the optical function element 306 and type of signal processing desired. The optical function element 306 may include an optical fiber 334 extending through the tube 308 for optically coupling the beam manipulating mechanism 316 to the optical connection arrangement 330. The optical fiber 334 may be an optical fiber bundle.

The connection arrangement 328 may also include an RF connection arrangement 336 configured to couple the RF element 302 or elements to an RF device 338. The RF device 338 may be an RF transceiver or other device for processing RF signals depending upon the desired output. A connection or connections 340 through the back-short 326 may connect the RF elements 302 to the connection arrangement 328 or RF connection arrangement 336.

The integral phased array module 301 may also include a lens 342 covering the RF elements 302 and optical function element 306. The lens 342 may include optical properties or characteristics for enhancing and/or directing an optical beam passing through the lens 342. An impedance matching material 344 may be disposed over the RF elements 302, optical function element 306 and the substrate 304 within the lens 342. The lens 342 may extend at least partially through an opening 346 in a wave impedance match (WAIM) cover plate 348 or sheet. The WAIM cover plate 348 may be configured to be transparent or to pass both RF and optical energy. The WAIM cover plate 348 may be configured or may include an optical shape configured to provide at least one of optimum energy collection, image formation and beam steering. The WAIM cover plate 348 may be made from a metal, metal alloy or other suitable WAIM material. Accordingly, the integral phased array module 301 defines integrated multi-band functionality in a single aperture 350 without substantially increasing the size of the substrate 304 or substantially altering the size or configuration of the footprint of the RF element 302 or elements.

Figure 4:
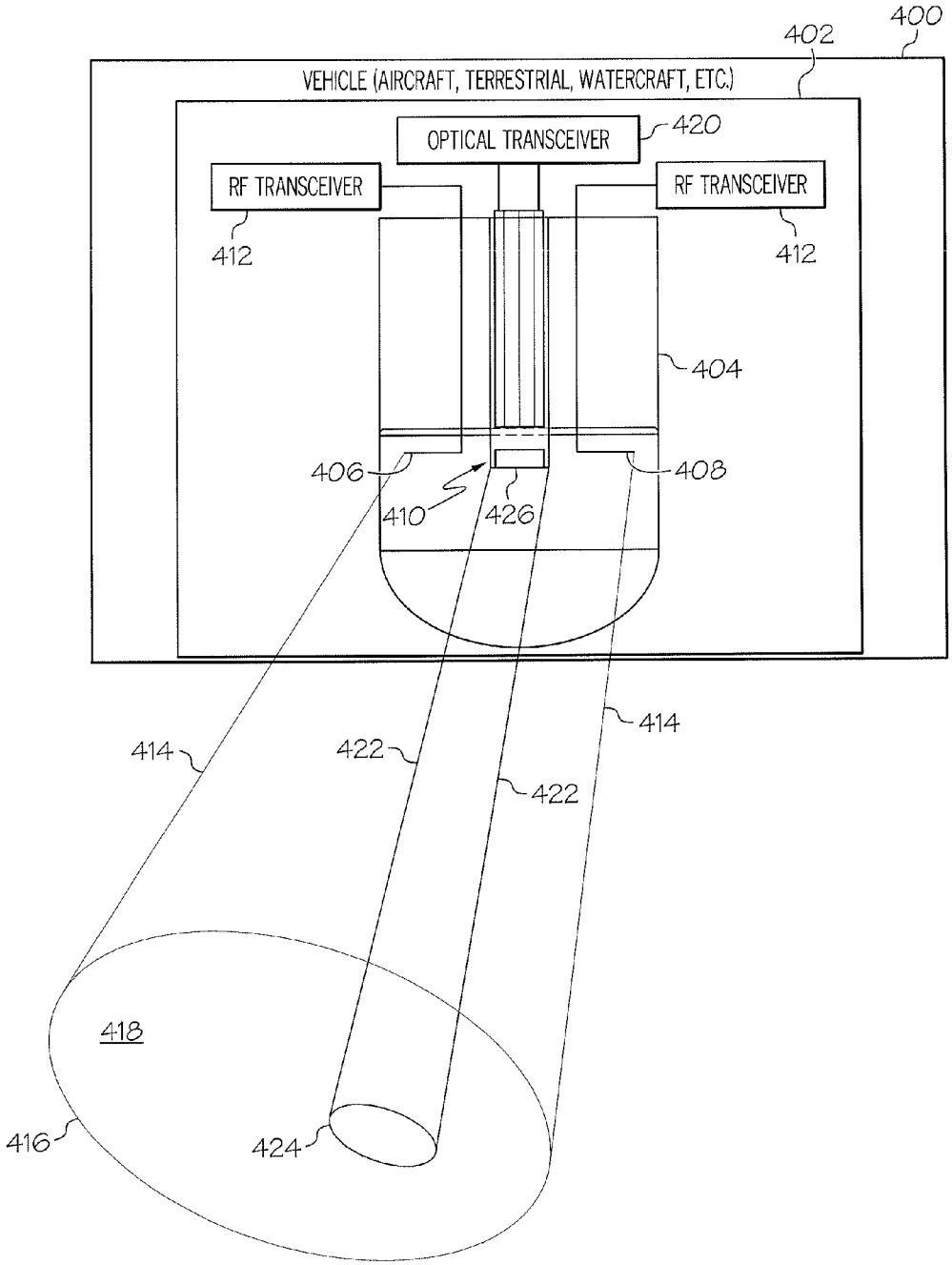
FIG. 4 is a block schematic diagram of an example a vehicle including a multi-band function system in accordance with an embodiment of the present disclosure.

FIG. 4 is a block schematic diagram of an example a vehicle 400 including a multi-band function system 402 in accordance with an embodiment of the present disclosure. The multi-band function system 402 may include an integral phased array module 404 or an array of integral phased array modules similar to that previously described. The integral phased array module 404 may be similar to the integral phased array module 100 of FIG. 1 or the integral phased array modules 301 of FIGS. 3A and 3B. The integral phased array module 404 may include an array of RF elements 406 and 408 and a function element 410 or an array of function elements. The function element 410 or array of function elements may be an optical function element similar to that previously described.

The multi-band function system 402 may also include an RF transceiver 412 that is configured for at least one of transmitting and receiving RF signals. The array of RF elements 406 and 408 may be connected to the RF transceiver 412. The array of RF elements 406 and 408 may include or define an array of antennas. The RF elements 406 and 408 or antenna array may transmit an RF beam 414 that may produce an RF beam spot 416 over a target area 418. Return signals or scattered signals from objects in the target area 418 may be received by the RF elements 406 and 408 and processed by the RF function elements 406 and 408.

The multi-band function system 402 may also include an optical transceiver 420. The function element 410 or elements may be coupled to the transceiver 420. The optical transceiver 420 may transmit and receive optical signals. The function element 410 may generate or receive an optical beam 422 that may produce an optical beam spot size 424 on the target area 418. The optical beam 422 may be controlled or manipulated by a beam manipulating mechanism 426 to control the optical beam spot size 424 and location of the optical beam spot size 424 within the RF beam spot size 416 or target area 418. The beam manipulating mechanism may be similar to the beam manipulating mechanism 208 in FIG. 2 or 316 in FIG. 3B.

Figure 5:
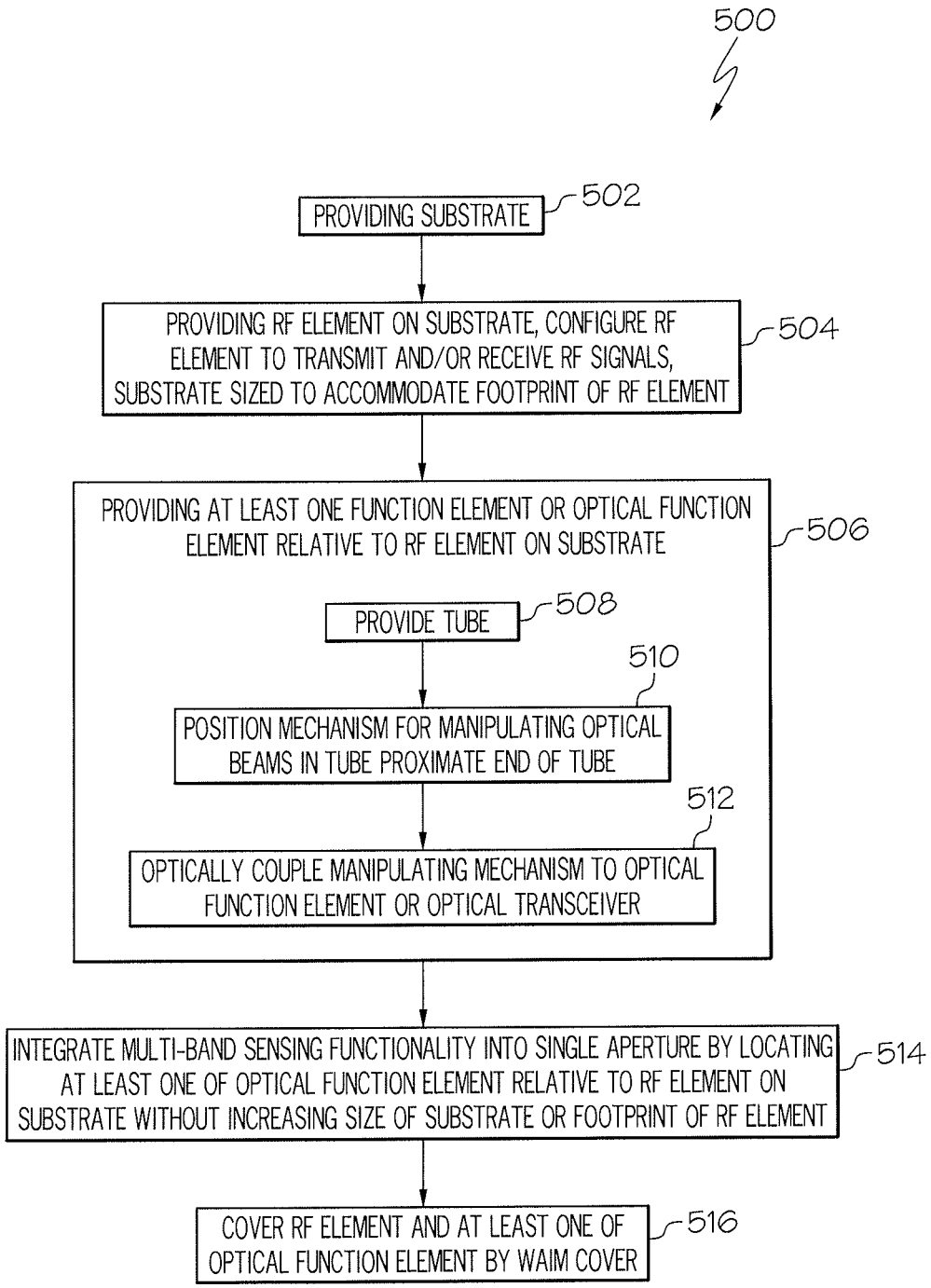
FIG. 5 is a flowchart of an example a method for integrating multi-band functionality in accordance with an embodiment of the present disclosure.

FIG. 5 is a flowchart of an example a method 500 for integrating multi-band functionality in accordance with an embodiment of the present disclosure. The method 500 may be performed by the integral phased array module 300 in FIG. 3B or multi-band function system 402 in FIG. 4. In block 502, a substrate may be provided. In block 504 an RF element or array of RF elements or antennas may be provided relative to the substrate or on the substrate similar to that previously described. The RF element or elements may be configured to at least one of transmit and receive RF signals. Similar to that previously described, the RF element or elements include a footprint of a particular size and shape with respect to the substrate and the substrate is sized to accommodate the footprint of the RF element or elements. The RF substrate may be sized to accommodate only the footprint of the RF element or elements prior to modification or integration of any function element or optical function elements similar to that described herein.

In block 506, at least one function element may be provided relative to the RF element or elements on the substrate. The at least one function element may be an optical function element. Blocks 508-512 further describe an example of providing at least one function element. In block 508, a tube may be provided. In block 510, a beam manipulating mechanism for manipulating optical beams may be positioned in the tube proximate an end of the tube.

In block 512, the beam manipulating mechanism may be optically coupled to an optical function element or an optical transceiver. The beam manipulating mechanism may be optically coupled to the optical function element or optical transceiver by an optical fiber or bundle of optical fibers similar to that previously described.

In block 514, multi-band functionality may be integrated into a single aperture by locating the function element or optical function element relative to the RF element on the substrate without substantially increasing the size of the substrate or substantially changing a size or configuration of the footprint of the RF element.

In block 516, the RF element or elements and the at least one optical function element may be covered by a cover plate. Similar to that previously described, the cover plate may be a WAIM cover plate. The WAIM cover plate may be configured to be transparent to both RF and optical energy. The WAIM cover plate may also include an optical shape configured to provide at least one of optimum energy collection, image formation and beam steering.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Although specific embodiments have been illustrated and described herein, those of ordinary skill in the art appreciate that any arrangement which is calculated to achieve the same purpose may be substituted for the specific embodiments shown and that the embodiments herein have other applications in other environments. This application is intended to cover any adaptations or variations of the present disclosure. The following claims are in no way intended to limit the scope of the disclosure to the specific embodiments described herein.

What is claimed is:

1. An integral phased array module, comprising:

a substrate;

a radio frequency (RF) transceiver element provided in relation to the substrate, the RF transceiver element being configured to at least one of transmit and receive RF signals, wherein the RF transceiver element comprises a footprint of a particular size and shape with respect to the substrate and the substrate is sized to accommodate the footprint of the RF transceiver element; and an optical function transceiver element configured to perform an optical function, the optical function comprising transmitting or receiving an optical beam, wherein the optical function transceiver element is located relative to the RF transceiver element on the substrate to avoid interference between the optical function transceiver element and the RF transceiver element and for transmitting or receiving the optical beam and transmitting or receiving the RF signals through a single aperture.

2. The integral phased array module of claim 1, wherein the optical function transceiver element comprises:

a tube comprising a first end extending through an opening in the substrate;

a beam manipulating mechanism for manipulating the optical beam, the beam manipulating mechanism being positioned in the tube proximate the first end of the tube; and an optical fiber for optically coupling the beam manipulating mechanism to an optical device.

3. The integral array module of claim 2, wherein the tube is made from a conductive material and is at ground electrical potential.

4. The integral phased array module of claim 2, wherein the tube comprises a cylindrically shaped tube.

5. The integral phased array module of claim 2, wherein the optical fiber comprises an optical fiber bundle.

6. The integral phased array module of claim 2, wherein the beam manipulating mechanism comprises a micro-optical-electro-mechanical system.

7. The integral phased array module of claim 1, further comprising a lens covering the RF transceiver element and the optical function transceiver element.

8. The integral phased array module of claim 7, further comprising a cover plate, wherein the cover plate comprises an opening formed therein the lens extending at least partially through the opening for sending and receiving the optical beam.

9. The integral phased array module of claim 8, wherein the cover plate comprises wave impedance match (WAIM) cover plate configured to pass RF energy.

10. The integral phased array module of claim 1, wherein the RF transceiver element comprises an array of antennas and the optical function transceiver element comprises a plurality of optical function transceiver elements.

11. The integral phased array module of claim 10, wherein each optical function transceiver element comprises:

a tube comprising a first end;

a beam manipulating mechanism for manipulating the optical beam, the beam manipulating mechanism being positioned in the tube proximate the first end of the tube; and an optical fiber for optically coupling the beam manipulating mechanism to an optical device.

12. The integral phased array module of claim 1, further comprising an optical wave impedance match (WAIM) cover disposed over the RF transceiver element and the optical function transceiver element, wherein the optical WAIM cover is configured to be transparent to both RF and optical energy.

13. The integral phased array module of claim 12, wherein the WAIM cover comprises an optical shape configured to provide at least one of optimum energy collection, image formation and beam steering.

14. A vehicle, comprising:

a vehicle body;

an array of integral phased array modules mounted to the vehicle body, each one of the integral phased array modules comprising:

a substrate;

a radio frequency (RF) transceiver element provided on the substrate, the RF transceiver element being configured to at least one of transmit and receive RF signals, wherein the RF transceiver element comprises a footprint of a particular size and shape on the substrate and the substrate is sized to accommodate the footprint of the RF transceiver element; and an optical function transceiver element configured to perform an optical function, the optical function comprising transmitting or receiving an optical beam, wherein the optical function transceiver element is provided on the substrate with the RF transceiver element and the optical function transceiver element is located relative to the RF transceiver element on the substrate to avoid interference between the optical function transceiver element and the RF transceiver element and for transmitting or receiving the optical beam and transmitting or receiving the RF signals through a single aperture.

15. The vehicle of claim 14, wherein the at least one of the optical function transceiver element comprises:

a tube comprising a first end;

a beam manipulating mechanism for manipulating the optical beam, the beam manipulating mechanism being positioned in the tube proximate the first end of the tube; and an optical fiber for optically coupling the beam manipulating mechanism to an optical device.

16. The integral phased array module of claim 14, further comprising a lens covering the RF transceiver element and the optical function transceiver element.

17. The integral phased array module of claim 16, further comprising a cover plate, wherein the cover plate comprises an opening formed therein the lens extending at least partially through the opening for sending and receiving the optical beam.

18. A method for integrating multi-band functionality, comprising:

providing a substrate;

providing an RF transceiver element on the substrate, the RF transceiver element being configured to at least one of transmit and receive RF signals, wherein the RF transceiver element comprises a footprint of a particular size and shape on the substrate and the substrate is sized to accommodate the footprint of the RF transceiver element; and providing an optical function transceiver element configured to perform an optical function, the optical function comprising transmitting or receiving an optical beam, wherein the optical function transceiver element is provided on the substrate with the RF transceiver element, the optical function transceiver element being located relative to the RF transceiver element to avoid interference between the optical function transceiver element and the RF transceiver element and for transmitting or receiving the optical beam and transmitting or receiving the RF signals through a single aperture.

19. The method of claim 18, further comprising providing a tube, the tube comprising a first end;

positioning a beam manipulating mechanism for manipulating the optical beam in the tube proximate the first end of the tube; and optically coupling the beam manipulating mechanism to an optical transceiver by an optical fiber.

20. The method of claim 18, further comprising covering the RF transceiver element and the at least one of the optical function transceiver element by an optical wave impedance match (WAIM) cover, wherein the optical WAIM cover is configured to be transparent to both RF and optical energy.

* * * * *